US011648651B2

(12) United States Patent
Marxkors et al.

(10) Patent No.: US 11,648,651 B2
(45) Date of Patent: May 16, 2023

(54) INSTALLATION TOOL FOR A WIRE THREAD INSERT

(71) Applicant: BÖLLHOFF VERBINDUNGSTECHNIK GmbH, Bielefeld (DE)

(72) Inventors: Andreas Marxkors, Hövelhof (DE); Holger Thommes, Strohn (DE); Tobias Beyer, Achern (DE); Maximilian Leinkenjost, Gütersloh (DE); Klemens Rucha, Paderborn (DE); Alexej Butov, Gütersloh (DE); Marcel Purrio, Bielefeld (DE); Hermann Zimmermann, Bielefeld (DE); Klaus-Friedrich Grubert, Bückeburg (DE); Sascha Zavarol, Delbrück (DE); Franz Lutz, Lichtenau (DE)

(73) Assignee: Böllhoff Verbindungstechnik GmbH, Bielefeld (DE)

( * ) Notice: Subject to any disclaimer, the term of this patent is extended or adjusted under 35 U.S.C. 154(b) by 113 days.

(21) Appl. No.: 16/962,390

(22) PCT Filed: Dec. 21, 2018

(86) PCT No.: PCT/EP2018/086579
§ 371 (c)(1),
(2) Date: Jul. 15, 2020

(87) PCT Pub. No.: WO2019/141497
PCT Pub. Date: Jul. 25, 2019

(65) Prior Publication Data

US 2021/0060746 A1 Mar. 4, 2021

(30) Foreign Application Priority Data

Jan. 16, 2018 (DE) ..... 10 2018 100 832.5

(51) Int. Cl.
*B25B 27/14* (2006.01)
*B25B 23/14* (2006.01)
*B25B 23/142* (2006.01)

(52) U.S. Cl.
CPC ..... *B25B 27/143* (2013.01); *B25B 23/141* (2013.01); *B25B 23/1427* (2013.01)

(58) Field of Classification Search
CPC . B25B 23/1427; B25B 23/147; B25B 23/145; B25B 23/141; B25B 27/143
(Continued)

(56) References Cited

U.S. PATENT DOCUMENTS 2,832,129 A * 4/1958 Forster ..... B25B 27/143 29/240.5
2,969,588 A * 1/1961 Stephens ..... B25B 27/143 29/240.5
(Continued)

FOREIGN PATENT DOCUMENTS

CN 1053570 A 8/1991
CN 201076924 Y 6/2008
(Continued)

OTHER PUBLICATIONS

English translation of the International Preliminary Report on Patentability for PCT/EP2018/086579 dated Jul. 21, 2020, (7 pages).
(Continued)

*Primary Examiner* — Don M Anderson
*Assistant Examiner* — Robert C Moore
(74) *Attorney, Agent, or Firm* — Reising Ethington P.C.; Matthew J. Schmidt

(57) ABSTRACT

The installation tool for a wire thread insert includes: a drive unit which provides a switchable rotation movement between a first and a second direction, a mandrel body with a drive section for rotating the mandrel body and with a
(Continued)

Figure 1A:
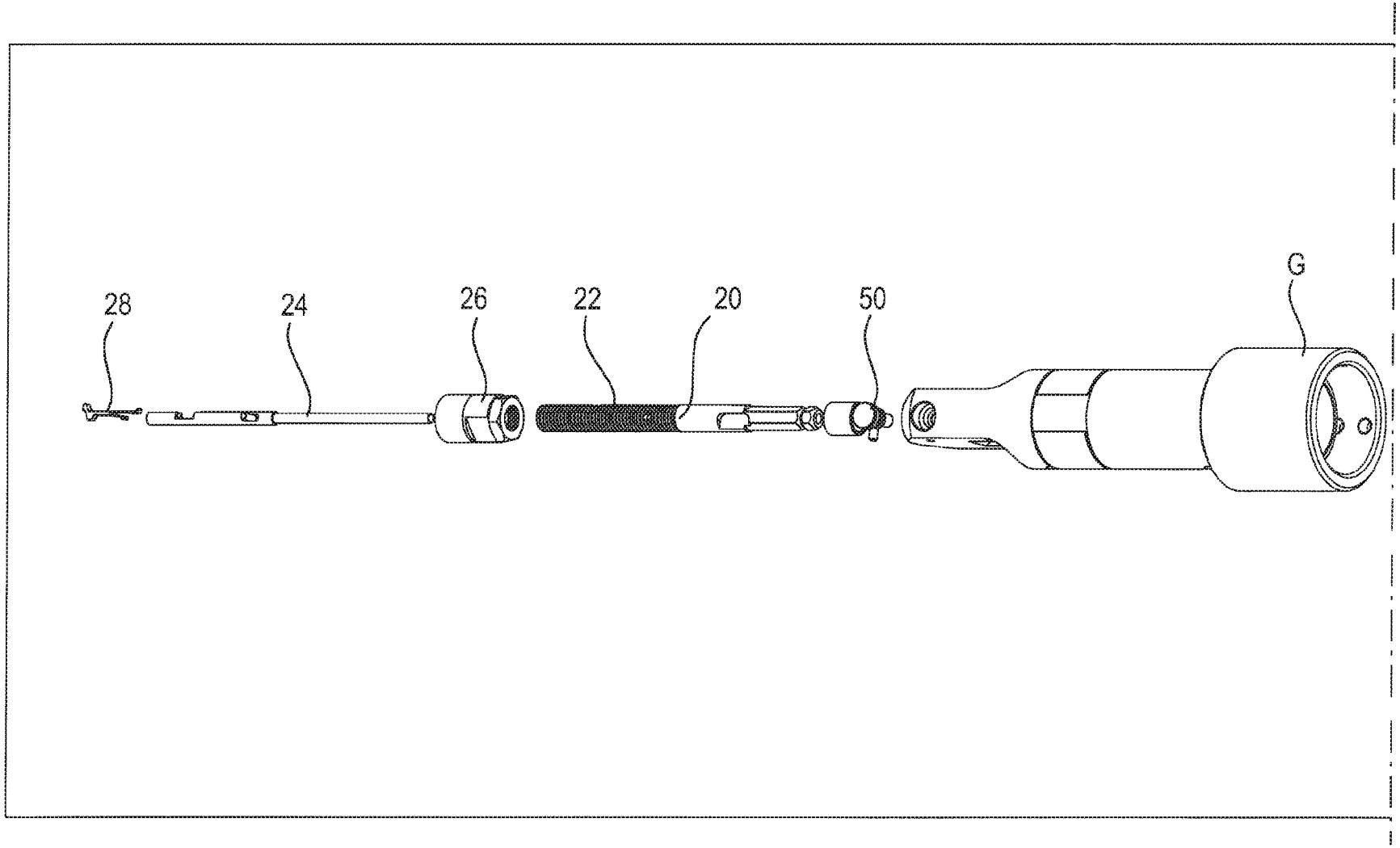

drive section for rotating the mandrel body and with a thread section onto which the wire thread insert can be screwed or rotated on, an installation blade as well as a torque clutch consisting of a form-fit and force-fit clutch upper and lower parts engaging each other, of which the upper part is connected with the drive unit in a torque-proof manner and the lower part is connected with the mandrel body in a torque-proof manner. With a decoupled relative rotation between the clutch parts, caused by exceeding a limit torque between the clutch parts, relative movement between the mandrel body and the installation blade can be generated.

14 Claims, 16 Drawing Sheets

(58) Field of Classification Search
USPC ..... 29/227, 240.5, 240; 81/475, 473, 81/467–483
See application file for complete search history.

(56) References Cited

U.S. PATENT DOCUMENTS 3,040,423 A * 6/1962 Brancato ..... B25B 27/143 29/240.5
3,442,362 A 5/1969 Bangerter
3,446,101 A * 5/1969 McKay ..... B25B 27/143 81/53.2
4,980,959 A 1/1991 Czarnowski
5,372,206 A 12/1994 Sasaki et al.
5,505,676 A 4/1996 Bookshar
5,617,623 A * 4/1997 Schron, Sr. ..... B25B 27/143 29/240
6,000,114 A * 12/1999 Newton ..... B25B 27/143 29/240.5
7,634,844 B2 12/2009 Szewc et al.
8,495,807 B2 7/2013 Szewc et al.
9,272,398 B2 3/2016 Keller et al.
9,719,546 B2 8/2017 Thommes et al.
9,764,454 B2 9/2017 Thommes et al.
2005/0274230 A1 12/2005 Lin
2006/0016300 A1* 1/2006 Bubel ..... B25B 23/1427 81/475
2009/0049961 A1 2/2009 Chen
2011/0132156 A1 6/2011 Lai
2013/0276287 A1* 10/2013 Thommes ..... F16B 35/00 29/428
2017/0284444 A1 10/2017 Thommes et al.
2017/0284445 A1 10/2017 Thommes et al.
2017/0284446 A1 10/2017 Thommes et al.

FOREIGN PATENT DOCUMENTS

CN 201800016 U 4/2011
CN 103747920 A 4/2014
DE 3200462 A1 7/1983
DE 4333599 A1 4/1994
DE 19501084 C2 12/1999
DE 102010050735 A1 5/2012
DE 102011051846 A1 1/2013
DE 102011080800 A1 2/2013
EP 1847357 A2 10/2007
WO 2006077120 A1 7/2006

OTHER PUBLICATIONS

CN Office Action for CN Application No. 201880086842.X dated Jun. 2, 2021 (12 pages).
Written Opinion & International Search Report for PCT/EP2018/086579 dated Apr. 5, 2019, 12 pages.
CN Office Action for CN Application No. 201880086842.X dated Jan. 25, 2022 (13 pages).

* cited by examiner

INSTALLATION TOOL FOR A WIRE THREAD INSERT

1. TECHNICAL FIELD

The present disclosure is related to an installation tool for a wire thread insert, a torque clutch which can be used in such tools as well as an installation method for a wire thread insert in a thread bore.

2. BACKGROUND

In the state of the art, installation tools with a rotating drive unit are generally known. Such installation tools are for example used for installing wire thread inserts in a thread bore, for screwing in a thread bolt or for tightening or loosening a female thread element on a thread bolt or the like. In this connection, pneumatic or electric engines serve as drive units. It is also conceivable that such installation tools be driven manually.

In order to avoid an overload condition when screwing in a thread bolt or during another connection that is to be made in a rotating manner, torque clutches are used in the state of the art. Such clutches are also referred to as overload clutches, as is described in DE 195 01 084 C2. The overload clutch illustrated there is used in a force-driven or engine-driven tool. This overload clutch is configured of driving clutch parts and driven clutch parts. The driving and driven clutch parts are connected with each other through spring means and a pretension force being generated in this connection. The clutch parts which are spring-pretensioned against each other include inlet and outlet cam discs which are arranged axially opposite to each other. Furthermore, clutch balls are arranged between those inlet and outlet cam discs, with these clutch balls interacting with the cams such that a releasable drive between the rotary drive inlet and the rotary drive outlet takes place. As soon as a critical torque has been reached, the clutch parts being spring-pretensioned against each other of the overload clutch interrupt the force flow between the drive side and the output side. In this way, it is avoided that an overload torque reaches the connection to be established and causes damages there.

While DE 195 01 084 C2 describes an overload clutch in combination with an electric engine, a torque clutch in combination with a switch-off mechanism for a pneumatic drive unit is described in U.S, Pat. No. 3,442,362. In this state of the art, too, the goal is that the transmission of a too big torque onto a connection to be established is avoided in due time, so that this connection but also the tool are not damaged.

Known overload clutches operate with clutch balls which are arranged between the spring-pretensioned clutch parts that are arranged opposite to each other. These clutch balls provide for a low friction between the clutch balls which realize the force flow and which are detachable from each other. At the same time, such a complex construction of an overload clutch causes a high effort in manufacturing and maintenance.

With regard to installation tools for wire thread inserts, it has become apparent that an interruption of the torque transmission alone when reaching a depth stop of the installation mandrel of the installation tool is not sufficient for realizing a comfortable installation. Rather, constructions of wire thread inserts meanwhile require a targeted release or separation of the installation mandrel from the screwed-in wire thread insert or also a targeted bending back of parts of the wire thread insert. For example, a wire thread insert with installation tangs is installed in a way that the installation mandrel generates a form-fit connection with the installation tang for screwing in the wire thread insert. In order to be able to release the mandrel from the thread opening again, the installation tang must be released from this form-fit connection.

A wire thread insert without installation tangs, having a dragging notch at a radial inner side, requires an installation blade in order to be able to screw in this wire thread insert into the thread bore. After having screwed the wire thread insert into the desired depth, this installation blade must be released from the engagement with the wire thread insert by suitably actuating the installation tool. Only then can a targeted reverse-rotation or screwing or rotation of the mandrel out of the thread opening take place.

The wire thread insert which is described in DE 10 2010 050 735 requires, after being screwed into the desired depth of the thread opening, a targeted bending back of its installation tang. Accordingly, it is necessary that an installation blade attaches to this installation tang which can be bent back, in order to bend it back into the thread of the thread opening. Only when this additional installation step has been completed should the installation mandrel be removed from the thread opening.

Based on the specific requirements for installation tools for wire thread inserts, it is the object of at least some implementations of the present invention to provide an installation tool for installing wire thread inserts, which, besides the protection against an overload torque, also automatically enables the realization of additional installation steps.

3. SUMMARY

The above object is solved by an installation tool for a wire thread insert 1, by a torque clutch being inserted into this installation tool as well as by an installation method for a wire thread insert into a thread opening with the help of the above-mentioned installation tool. Further embodiments, developments and modifications of the present disclosure are set forth in and apparent from the following description, the accompanying drawings as well as the appending claims.

The wire thread insert installation tool comprises the following features: a drive unit, in particular an electric or pneumatic drive unit, providing a switchable rotation movement switchable between a first and a second direction, a mandrel body with a driving section for rotating the mandrel body and with a thread section onto which the wire thread insert can be screwed or rotated and from which the wire thread insert can be rotated, an installation blade which is arranged movably in the mandrel body between an engagement position and a rest position in order to attach at the wire thread insert in a targeted manner and/or to release itself from an attachment or engagement at the wire thread insert, and a torque clutch which consists of a clutch upper part and clutch lower part engaging into each other in a form-fit and force-fit manner, of which the clutch upper part is connected torque-proof with the drive unit and the clutch lower part is connected torque-proof with the mandrel body, while a relative movement, in particular a linear relative movement, between the mandrel body and the installation blade can be generated with a de-clutched or decoupled relative rotation between the clutch upper part and the clutch lower part, caused by exceeding a predetermined limit torque between the clutch upper part and the clutch lower part.

Due to its configuration, the above installation tool for a wire thread insert first of all supports the prevention of torque overload conditions when inserting or installing or screwing in the wire thread insert into a thread opening, as the used torque clutch releases the connection between the drive side and the output side of the installation tool as soon as a critical torque, e.g. when the installation mandrel runs aground an axial stop, is reached. With this releasing movement of the torque clutch, an actuation movement, which may be a linear actuation movement, between one of the clutch halves and a movable actuator is, however, also caused at the same time. These clutch halves are formed by the above-mentioned clutch upper part and the clutch lower part. That means that while an overload condition during the rotation movement causes the connection between the clutch upper part and the clutch lower part to be released, an axial movement along a rotation axis of the clutch upper part and the clutch lower part may be caused at the same time.

This axial relative movement between the mentioned actuator and the clutch upper part and/or the clutch lower part can be used for a further work step during the installation of the wire thread insert into a thread bore. This axial relative movement of the actuator may be used when releasing an installation blade of the installation tool from an engagement with the wire thread insert. Another alternative is to displace the installation blade in an engagement position or in another assembly position within the installation mandrel and/or at the wire thread insert. A further embodiment is that by means of the axial relative movement of the actuator, besides an installation blade, a further adjustment element is actuated. This actuation element can for example be used for releasing the installation tang from an engagement of the installation mandrel.

According to a further embodiment of the installation tool, the clutch lower part and the clutch upper part are arranged in a spring-pretensioned manner against each other so that in case of a rotation blockage of the clutch lower part via the mandrel body, the clutch upper part can be rotated with respect to the clutch lower part, with the clutch lower part giving way in a springy manner.

Due to the design of the sides of the clutch lower part and clutch upper part which face each other, both clutch parts form a form-fit and/or force-fit connection supported by spring-pretension. The spring pretension which is impressed into the clutch parts determines an actuation torque between the two clutch parts, causing a release of the connection between the clutch lower part and the clutch upper part. This release of the clutch parts from each other takes place precisely when the mentioned rotation blockage of the clutch lower part or the clutch upper part occurs.

According to the present disclosure, it may be preferred that the clutch lower part is connected with the mandrel body, so that a rotation blockage of the mandrel body causes a standstill of the clutch lower part. The clutch upper part may be further rotated by the drive unit, exceeding a critical torque between both clutch parts leads to overcoming the spring pretension between the clutch lower part and the clutch upper part. Accordingly, the clutch upper part then continues to rotate compared with the clutch lower part, which causes the torque clutch to release. The provided spring pretension between the clutch lower part and the clutch upper part thus offers the possibility that the clutch lower part may give way to a continued rotation of the clutch upper part by means of an axial displacement.

According to a further embodiment of the installation tool, the clutch upper part comprises a link motion or link guide with which an axial actuator of the clutch upper part in dependency of the rotation direction of the clutch upper part can be axially displaced, with the axial actuator not co-rotating with the clutch upper part. In this connection, it may furthermore be preferred that the axial actuator is a clutch piston guided axially in the clutch upper part with an at least one-sided radially protruding roller pin which engages into the link guide.

The wire thread insert installation tool is provided such that the mandrel for installing the wire thread insert is connected with the clutch lower part. Accordingly, the mandrel and thus the clutch lower part, too, are blocked during installation as soon as a certain installation depth or an axial stop of the mandrel has been reached. In this situation, the rotation blockage of the mandrel leads to a rotation standstill of the clutch lower part, it does, however, not prevent a further rotation of the clutch upper part due to the arising overload torque.

As the clutch upper part rotates relative with respect to the centrally arranged clutch piston, the link guide which is connected in a form-fit manner with the clutch piston leads to an axial displacement of the clutch piston. This movement, which can be understood as a secondary use of the actuation movement between the clutch upper part and the clutch lower part is used for the targeted movement or a switching or actuation of an axial actuator in the present disclosure. Depending on the design of the link guide, which may determine a movement path of the engaging roller pin here, the movement profile of the axial actuator can be defined.

According to a further embodiment, the link guide defines a curvilinear path, in particular a helix path, in the clutch upper part, which causes a relative axial displacement between the clutch upper part and the clutch piston when the clutch upper part is rotated relative to the clutch piston.

Depending on the preferred circumferential course of the link guide, a direction, a size of an axial displacement as well as a speed of an axial displacement taking place can be adjusted. It therefore may be preferred that the movement of the actuator is adjusted or adapted to the installation function to be realized of the installation tool via the shape of the link guide.

According to a further embodiment of the wire thread insert installation tool, the axial displacement of the clutch piston can be transferred to the installation blade via an actuator. The installation blade, which is arranged within the mandrel body, is used during installation of a wire thread insert and/or during an uninstallation of the wire thread insert or during a processing of the wire thread insert in the thread opening. Accordingly, the moved actuator and the movement which has been transferred to the installation blade is used for carrying out installation steps, processing steps and/or uninstallation steps at a wire thread insert in a thread opening.

According to a further embodiment of the wire thread insert installation tool, the above-mentioned axial displacement takes place depending on the rotation direction of the clutch upper part compared with the clutch lower part into the direction of the mandrel body or into the direction of the drive unit. According to the disclosure, it may furthermore be preferred that the clutch upper part and the clutch lower each comprise, in an axial orientation of face sides opposite to each other, a circumferential sequence of at least two contra-directional ramps being adjacent with respect to a common vertex, with the ramps defining an engagement contour between the clutch upper part and the clutch lower part.

Besides the spring pretension between the clutch upper part and the clutch lower part, which was already discussed above, the strength of the releasable connection between the clutch upper part and the clutch lower part is also determined by the engaging contours of the surfaces facing each other or face sides, respectively, of the clutch upper part and the clutch lower part. According to the disclosure, these surfaces of clutch upper part and clutch lower part each include at least one cam which comprises two contra-directional ramps which are connected via the common vertex. An inclination of these ramps as well as the spring pretension which presses the clutch upper part and the clutch lower part against each other, define a release torque which enables the clutch upper part to glide away in a rotating manner on the rotation-blocked clutch lower part. Depending on the application area of the installation tool, the shaping contour of the facing sides of the clutch upper part and the clutch lower parts as well as the strength of the spring pretension between the clutch upper part and the clutch lower part can be chosen and/or adjusted in a targeted manner.

In connection with the above description, it may therefore also be preferred that an inclination angle of the ramps in combination with the spring pretension between the clutch upper part and the clutch lower part determines a limit torque at which a relative movement between the clutch upper part and the clutch lower part can be generated.

The present disclosure also includes the torque clutch which is used in the above described wire thread insert installation tool. This torque clutch can also be used for other tools in which a rotating drive unit is used. This torque clutch comprises the following features: clutch upper part and clutch lower part engaging with each other in a form-fit and force-fit manner, of which the clutch upper part or the clutch lower part can be connected in a torque-proof manner with a drive unit and the other clutch part can be connected in a torque-proof manner with an output unit, while with an uncoupled relative rotation between the clutch upper part and the clutch lower part caused by exceeding a limit torque between the clutch upper part and the clutch lower part, a linear relative movement between the clutch part that is clutched to the drive unit and an actuation unit that is arranged in this clutch part and is axially moveable can be generated.

According to a further embodiment, the torque clutch comprises the feature that the clutch lower part and the clutch upper part are arranged against each other in a spring-pretensioned manner so that in case of a rotation blockage of the clutch lower part, the clutch upper part can be rotated with respect to the clutch lower part. This configuration ensures that the torque clutch effectively releases the connection between the clutch lower part and the clutch upper part when a critical torque is exceeded.

It may furthermore be preferred that the clutch upper part comprises a link guide with which an axial actuator of the clutch upper part can be axially displaced relative to the actuator depending on a rotation direction of the clutch upper part. It may furthermore be preferred that the axial actuator is a clutch piston that is guided axially in the clutch upper part, having at least a one-sided radially protruding roller pin which engages into the above-mentioned link guide. In this connection, it may be preferred that the link guide is defined as a curvilinear path, in particular a helix path, in the clutch upper part which causes a relative axial displacement between the clutch upper part and the clutch piston when the clutch upper part is rotated.

In order to be able to use this relative axial displacement between the clutch upper part and the clutch piston, it can be transferred via an actuator to the actuation unit, in particular to an actuation unit that is arranged within the drive unit. Furthermore, the axial displacement may take place depending on the rotation direction of the clutch upper part compared with the clutch lower part into the direction of the output unit or into the direction of the drive unit.

As already described above in combination with the installation tool for a wire thread insert, the clutch upper part and the clutch lower part each comprise, in an axial orientation opposite to each other, a circumferential sequence of at least two contra-directional ramps being adjacent with respect to a common vertex, with the ramps defining an engagement contour, such as a direct engagement contour, between the clutch upper part and the clutch lower part. The used inclination angle of the ramps into the direction of the vertex generate, in combination with a spring pretension between the clutch upper part and the clutch lower part, a limit torque, at which a relative rotation between the clutch upper part and the clutch lower part and a relative displacement between an actuator and the clutch upper part or the clutch lower part can be generated.

Furthermore, the present disclosure includes an installation method for a wire thread insert in a thread opening with an installation tool according to one of the above described embodiments. The installation method comprises the following steps: rotating or screwing the wire thread insert on the mandrel body in a first rotation direction of the mandrel body, placing the mandrel body with the wire thread insert in position at the thread opening and screwing in the wire thread insert into the thread opening with the help of the mandrel body by rotating the mandrel body in the first rotation direction until a stop blocks a further axial screwing of the mandrel body, actuating the torque clutch by blocking the mandrel body so that the installation blade is put, via a relative movement to the mandrel body, into an attachment position/operation position or is put from the operation position into a rest position, and rotating the mandrel body in a second rotation direction until the wire thread insert is rotated off from the mandrel body.

The installation method that may be preferred for a wire thread insert uses the above-described advantageous features of the installation tool with torque clutch. A wire thread insert is usually screwed into the thread opening with the help of the installation tool so deep until the mandrel of the installation tool is blocked from a further rotation movement by a depth stop. This depth stop determines up to which depth the wire thread insert should be installed in the thread opening. However, at the same time, the blockage of the rotation movement of the mandrel leads to the prevention of a further common rotation of the clutch upper part and clutch lower part due to the releasable form-fit and force-fit connection present between them. As, however, there is still an operation connection between the drive unit and the torque clutch, the clutch upper part continues to rotate despite the rotation blockage of the clutch lower part, so that the torque clutch releases the connection between the mandrel body and the drive unit. By releasing this operation connection between the drive unit and the mandrel body, an axial relative movement between the clutch upper part and a clutch piston that may be arranged therein is caused at the same time. This clutch piston is held radially in a link guide which converts the continuing rotation movement of the clutch upper part into an axial relative movement between the clutch piston and the clutch upper part. This axial relative movement can be transferred to the mandrel body and the installation blade arranged therein and is transferable into a movement of the installation blade.

Furthermore, the installation method may comprise the further step: bending back an installation tang of the wire thread insert into a thread of the thread opening by means of the installation blade that is displaced in an attachment position during rotation in the second rotation direction. Furthermore, a compression of the installation tang after bending back and switching of the torque clutch when a limit torque is reached occurs in combination with a displacing of the installation blade from an attachment position at the wire thread insert into a rest position. According to a further embodiment of the installation method, a manual or an automatic switch between the first and the second rotation direction takes place.

4. BRIEF DESCRIPTION OF THE ACCOMPANYING DRAWINGS

Figure 1B:
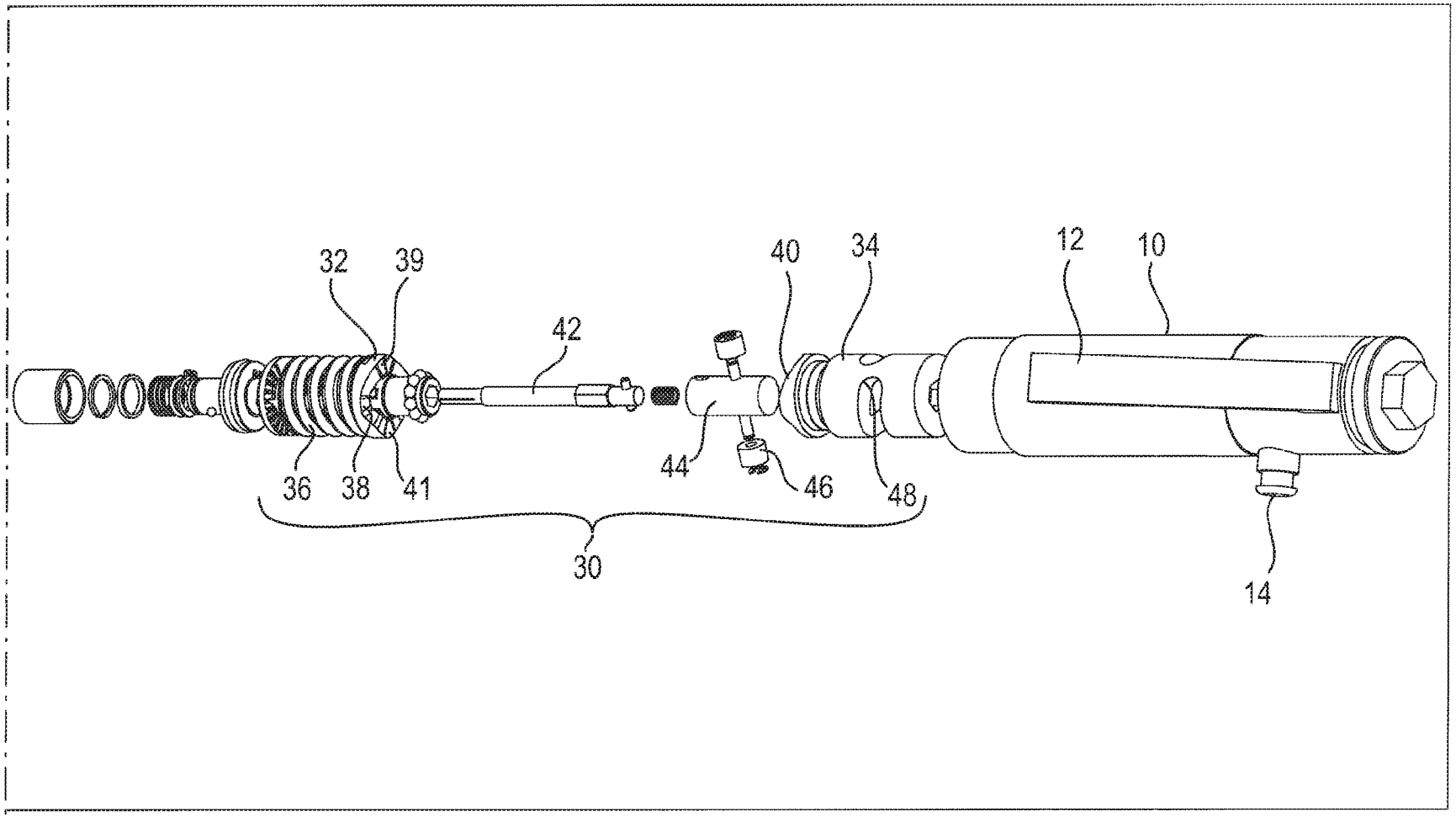
Figure 2:
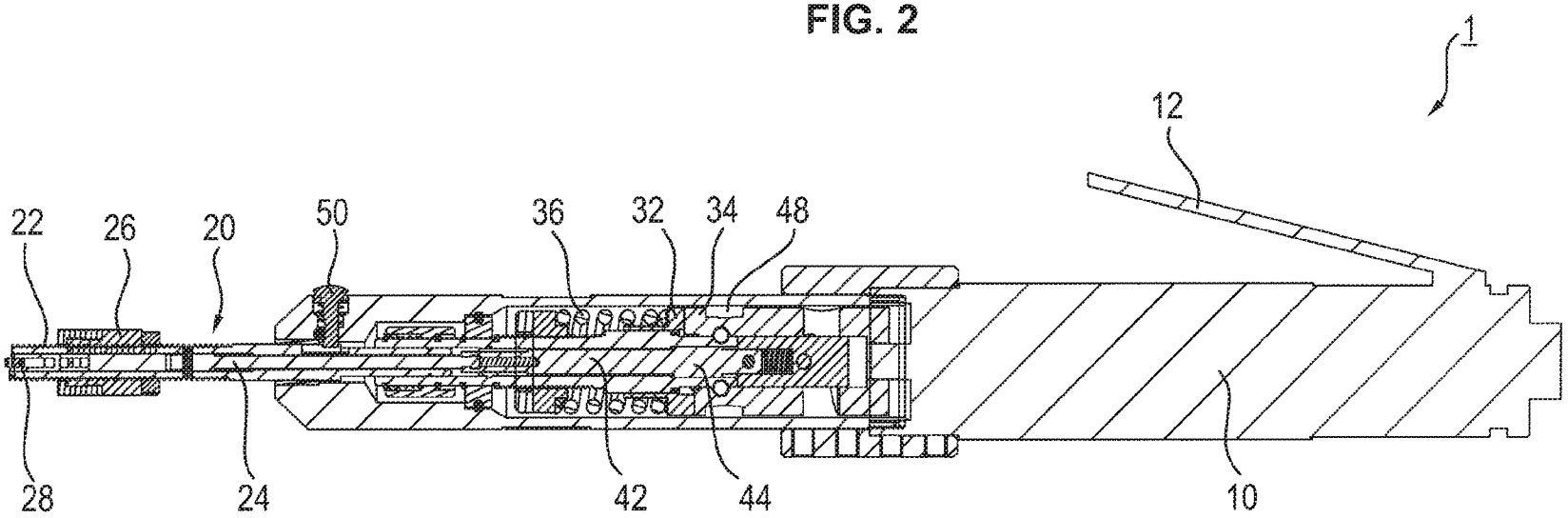
Figure 3:
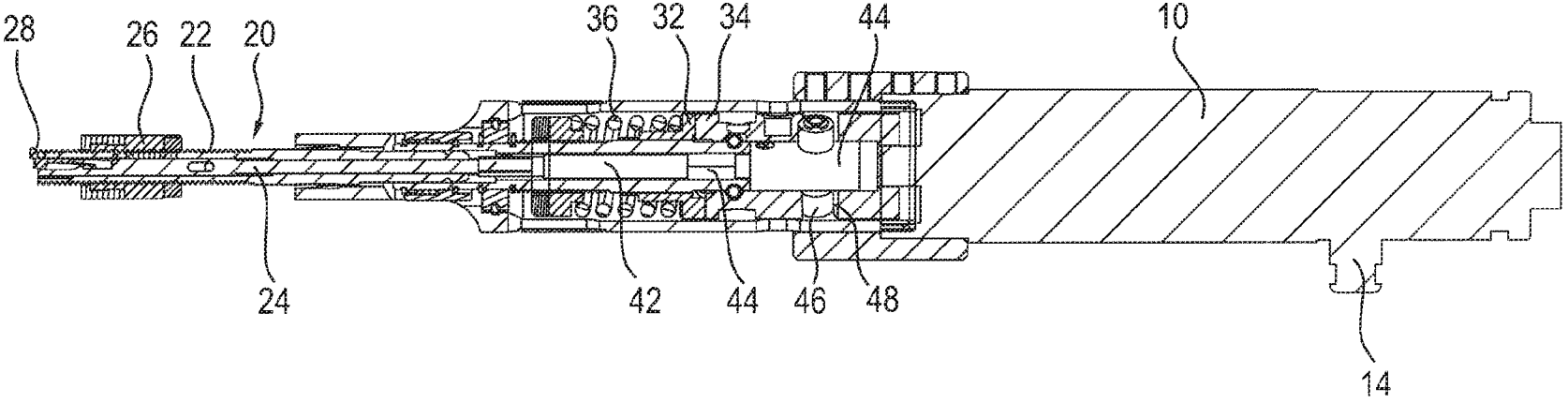
Figure 4:
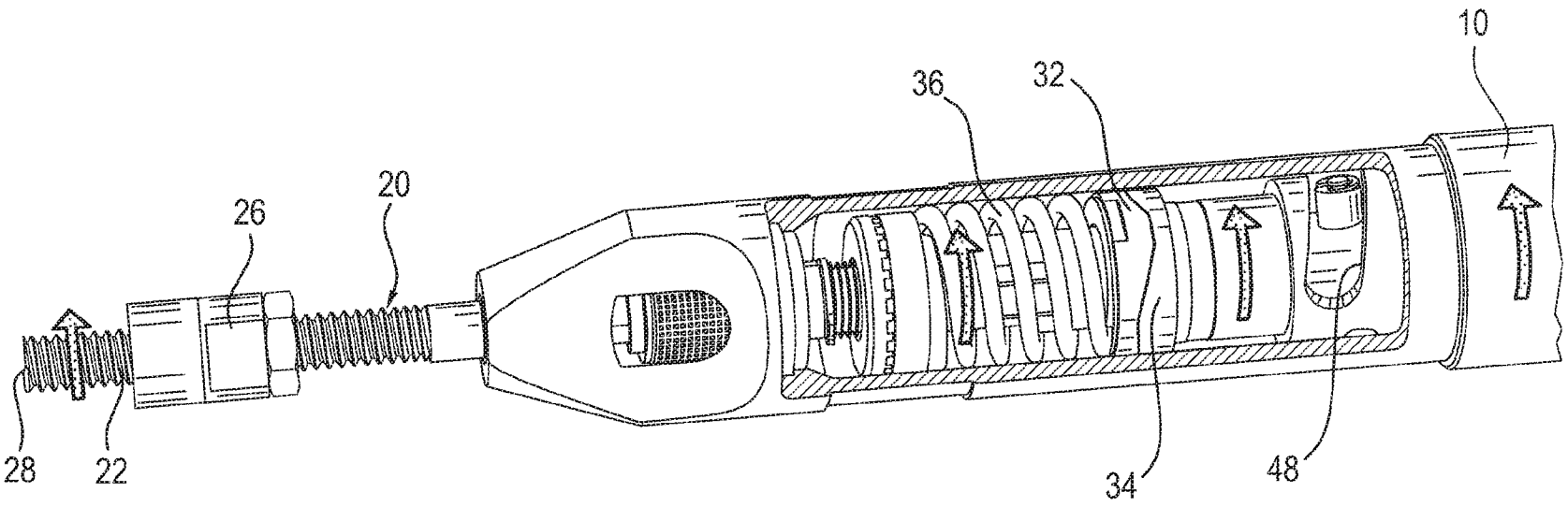
Figure 5:
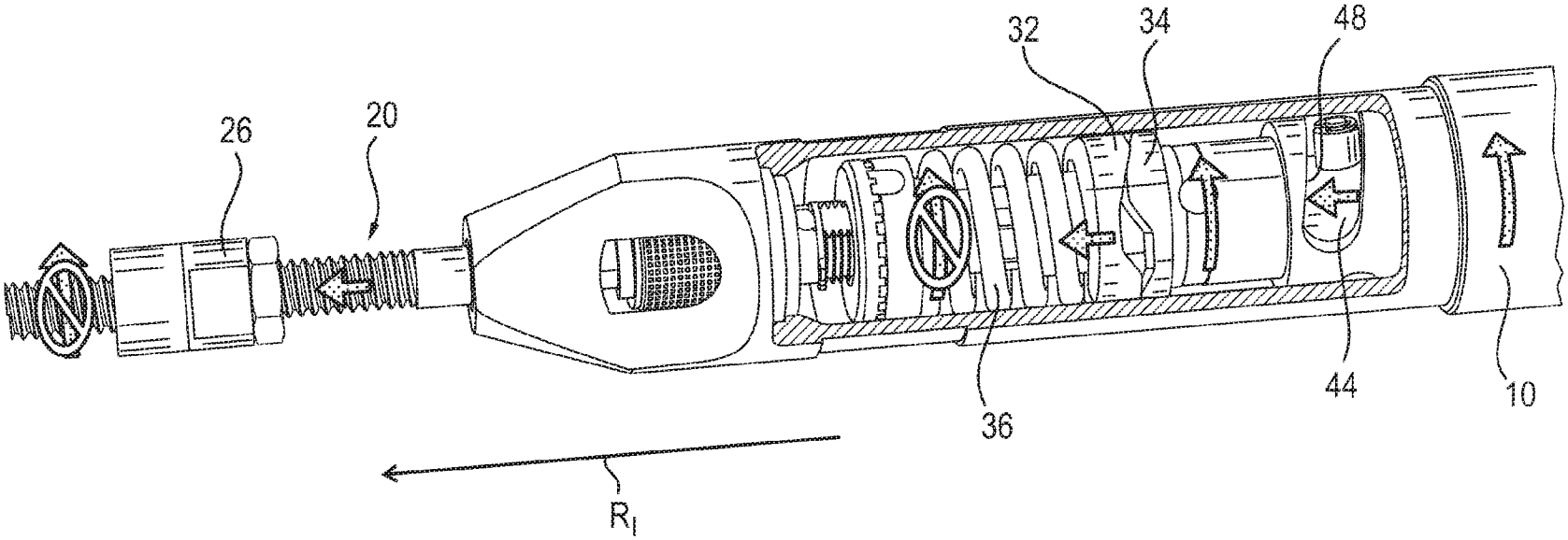
Figure 6:
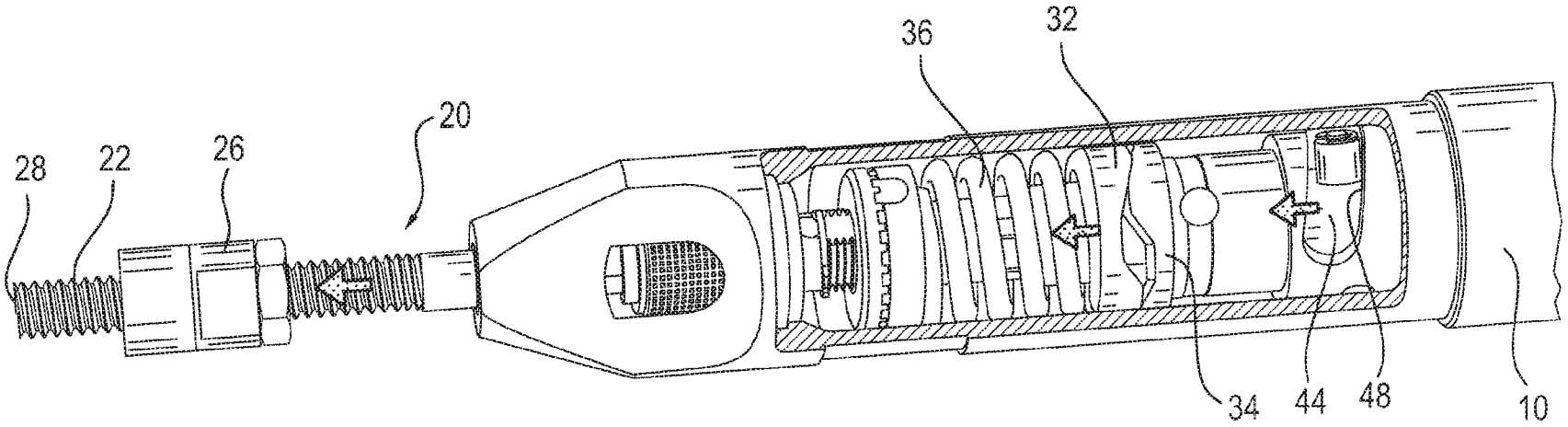
Figure 7:
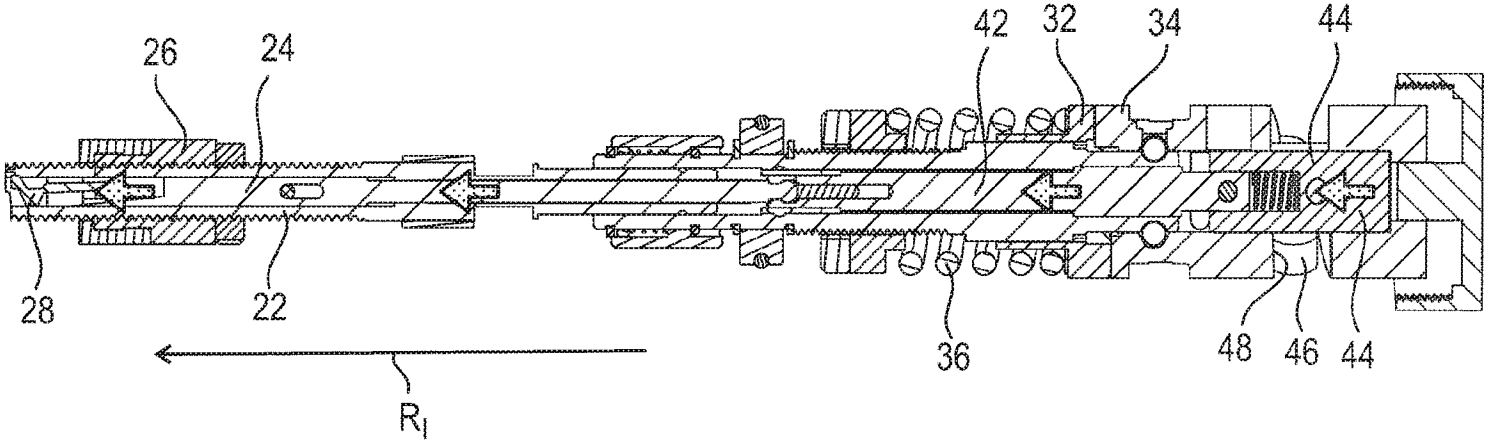
Figure 8:
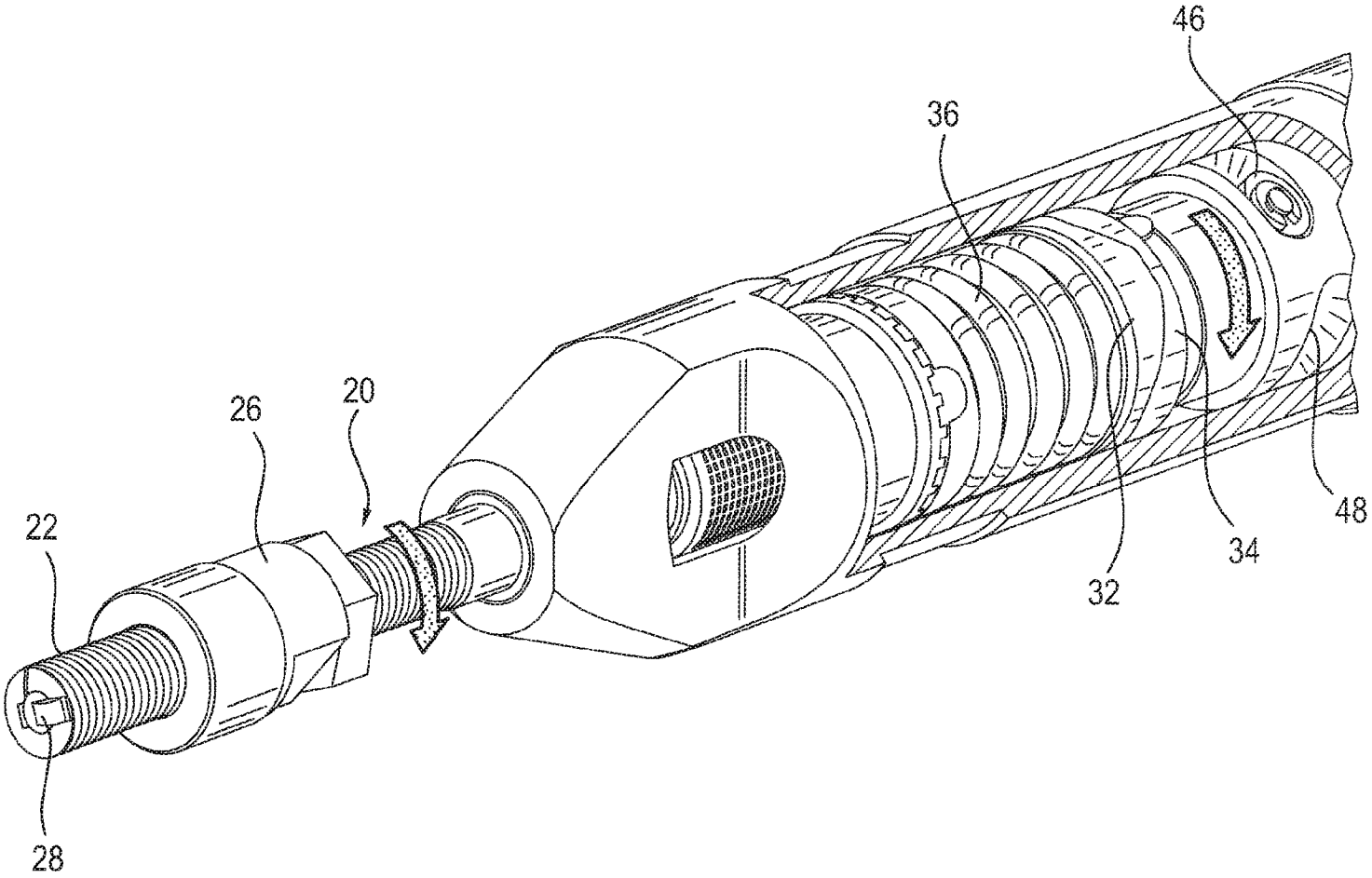
Figure 9:
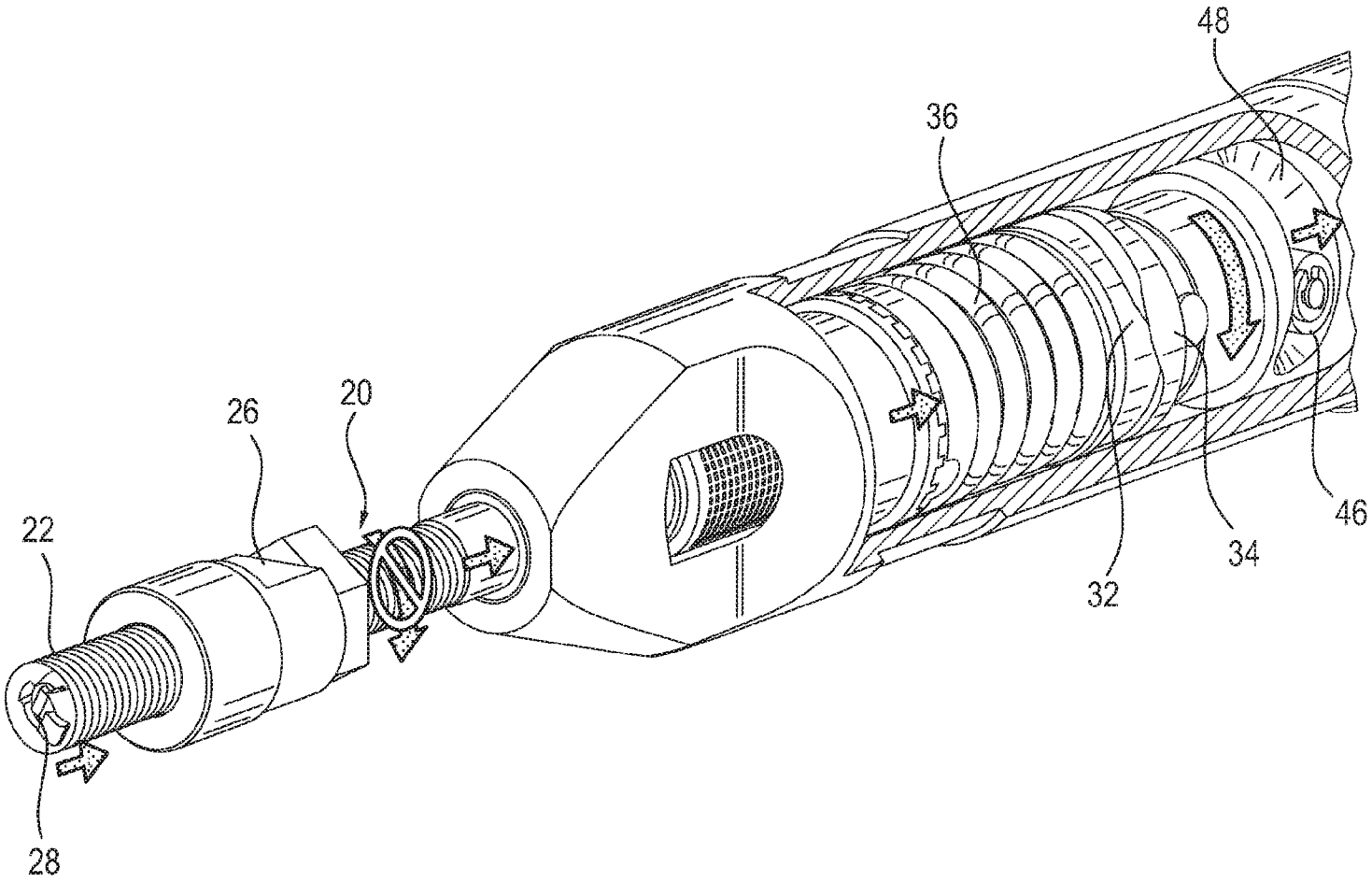
Figure 10:
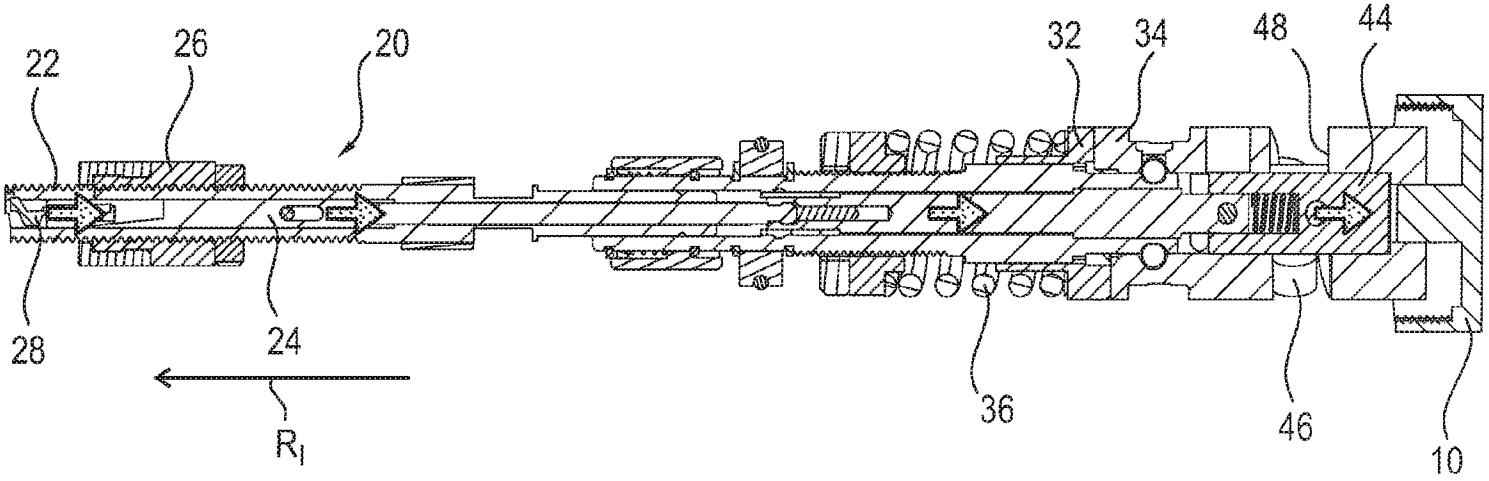
Figure 11:
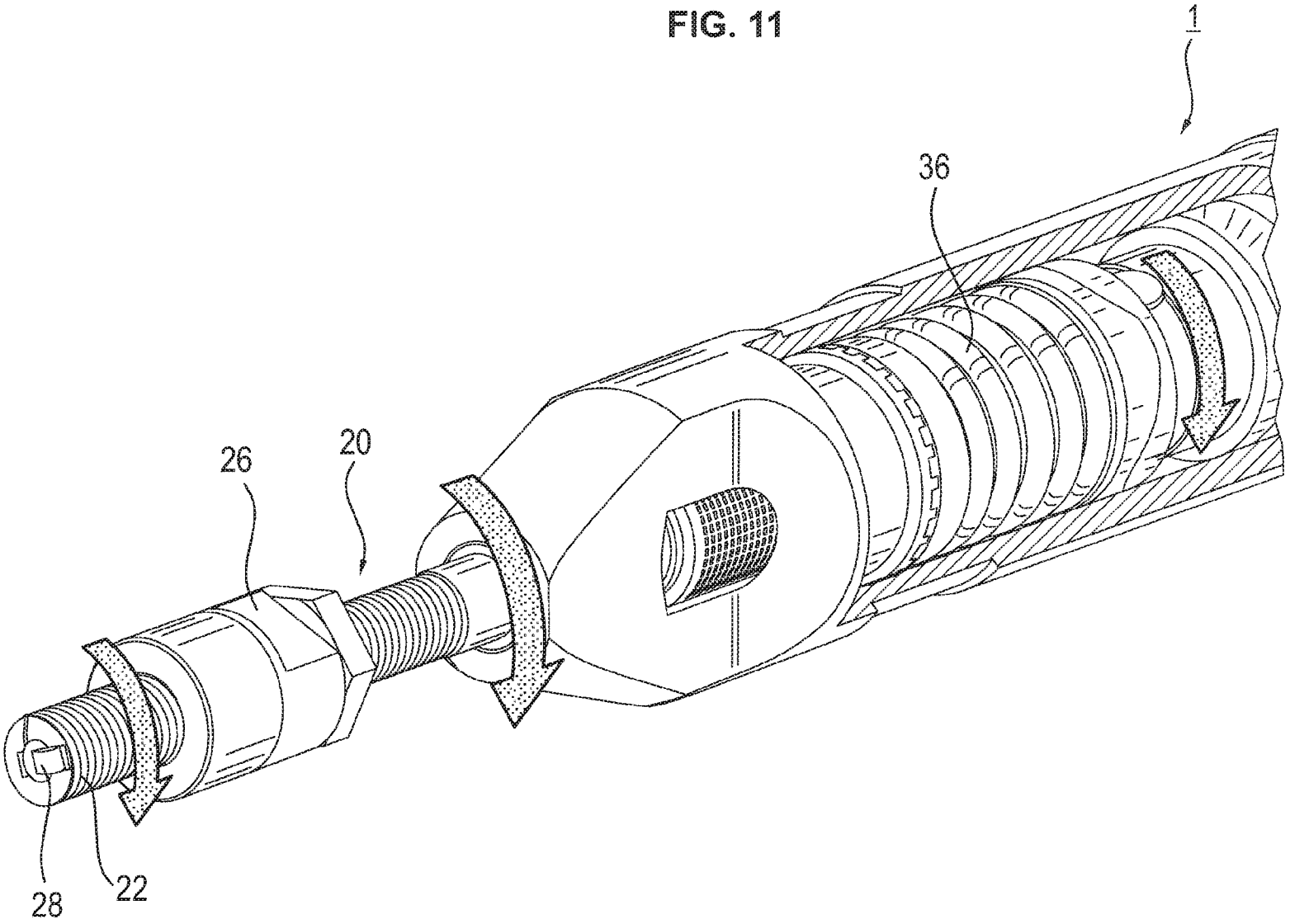
Figure 12:
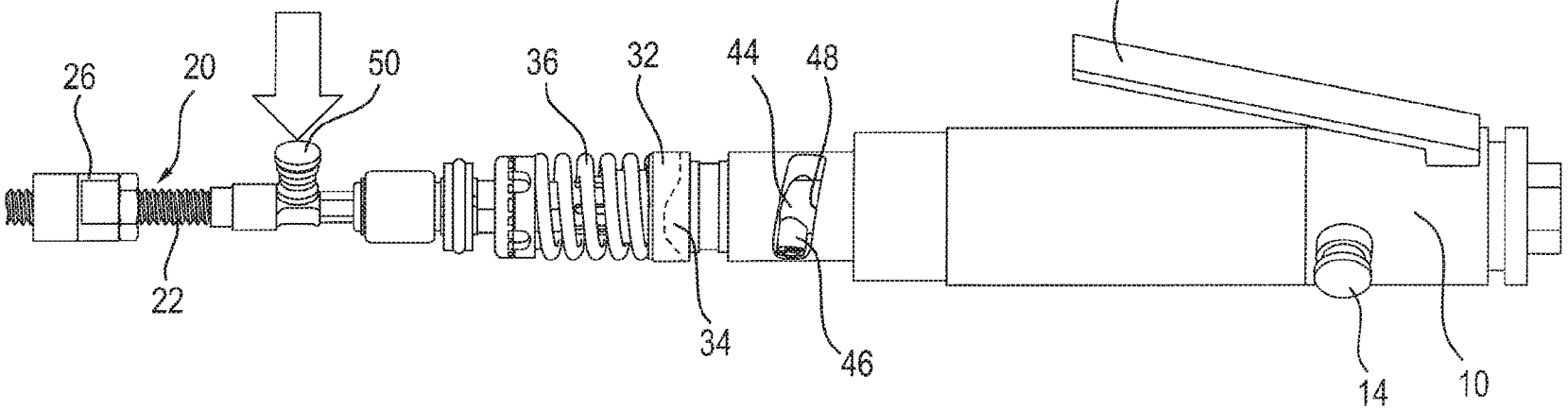
Figure 13:
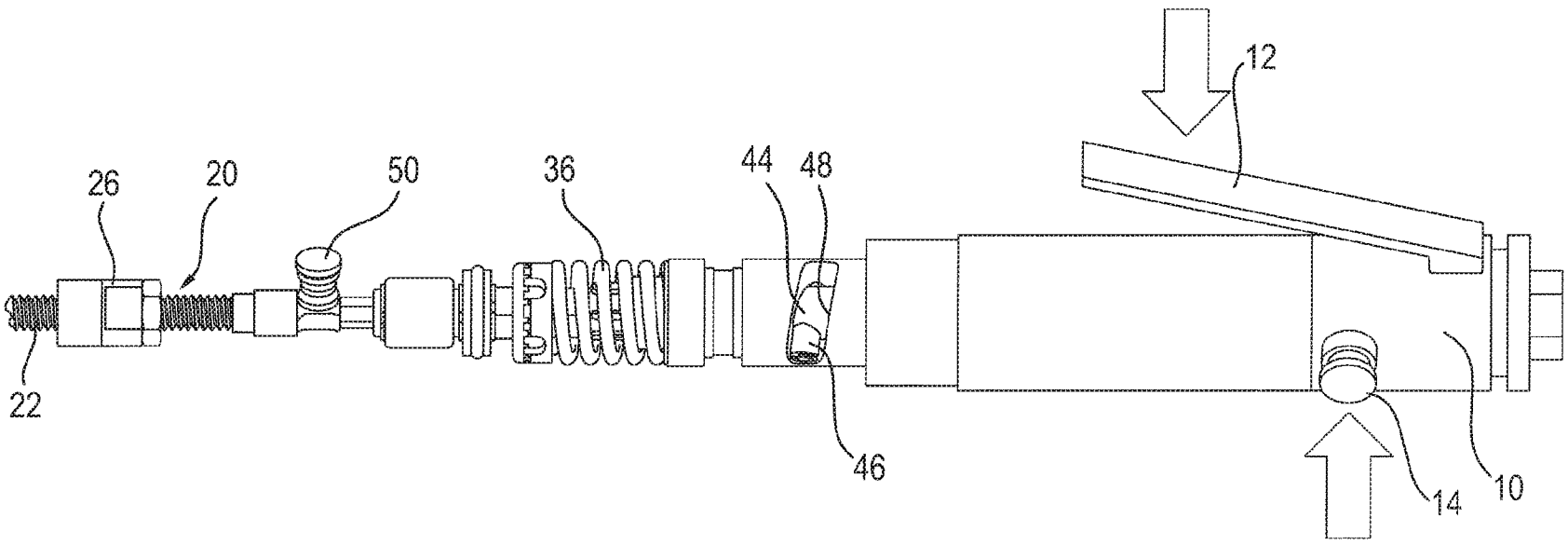
Figure 14:
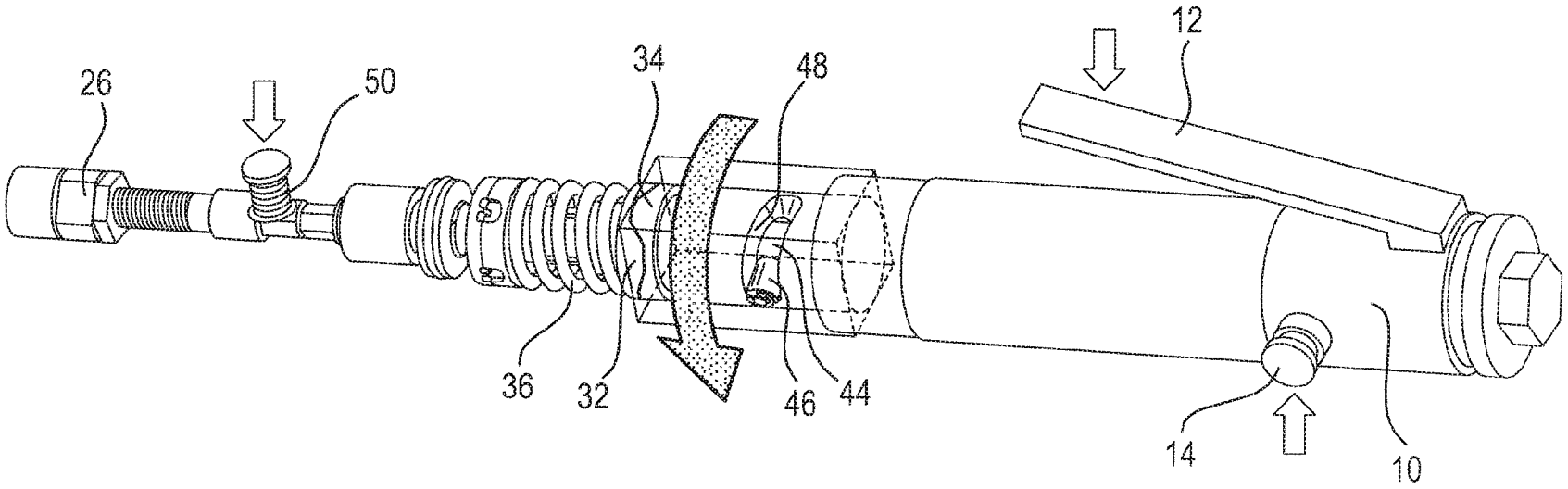
Figure 15:
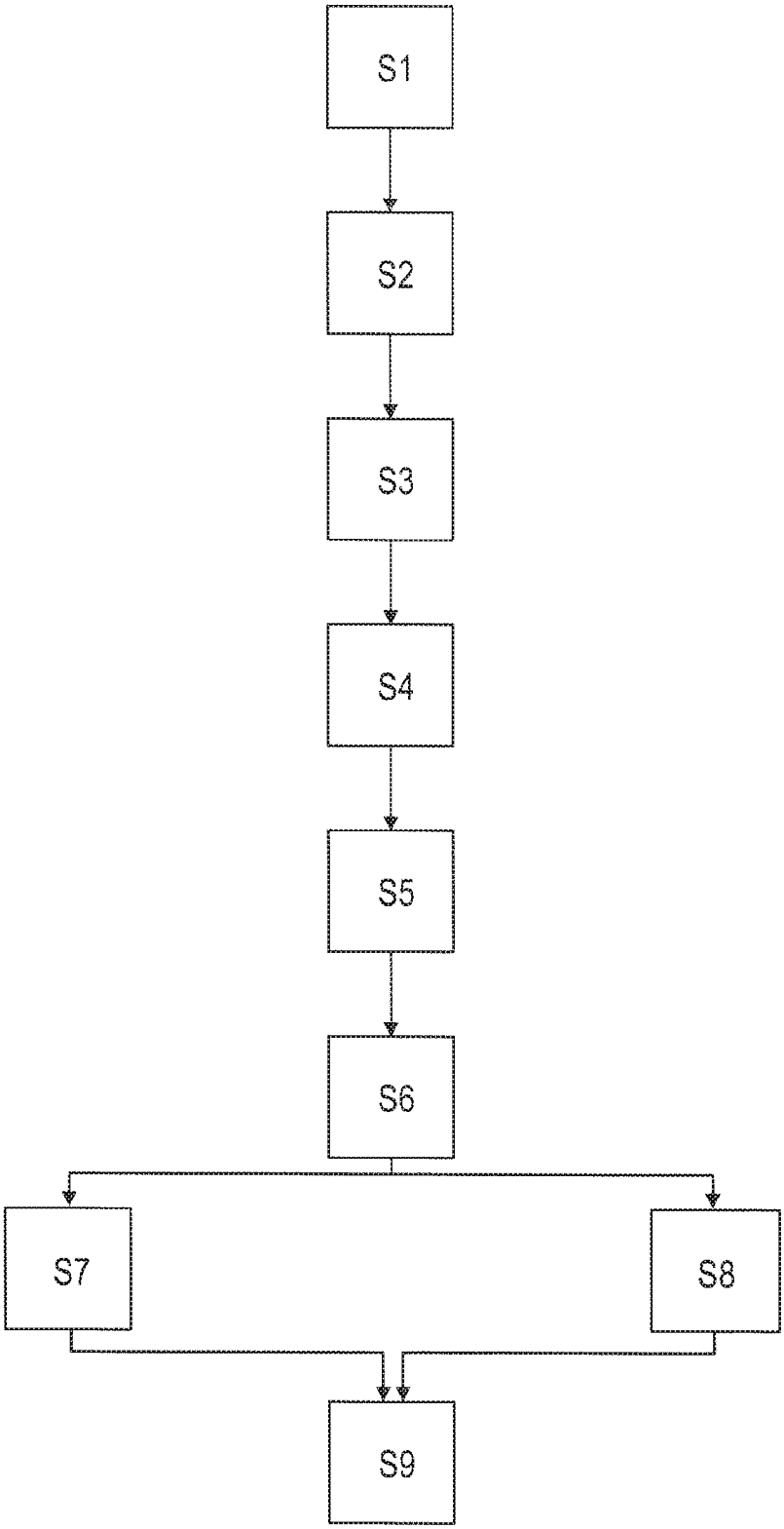

The embodiments of the present disclosure are described in more detail with reference to the accompanying drawings. It shows:

FIGS. 1*a* and 1*b* are exploded views of an embodiment of the installation tool, FIG. 2 a sectional side view of an embodiment of the installation tool, FIG. 3 a further sectional side view of the installation tool, FIG. 4 an illustration of a first movement sequence of the installation tool when the wire thread insert is screwed into a thread opening, FIG. 5 a further movement sequence of the installation tool when the further rotation of the mandrel body is blocked due to the depth stop, FIG. 6 an illustration of a subsequent movement sequence to a blockage of the mandrel body due to the depth stop, FIG. 7 a sectional view of an embodiment according to FIG. 6 with respect to the illustration of the inner motion cycles in the installation tool, FIG. 8 an illustration of a further motion sequence of the installation tool when rotating back the mandrel body, FIG. 9 an illustration of a further motion sequence while rotating back the installation tool, FIG. 10 a sectional view of an embodiment of the installation tool according to FIG. 9 with respect to the illustration of the inner motion processes in the installation tool, FIG. 11 an illustration of a further motion sequence of the installation tool while being rotated back, FIG. 12 an embodiment of the anti-interference blockage of the installation tool, FIG. 13 an illustration of the control of the installation tool when using the anti-interference function, FIG. 14 an illustration of the motion cycles while using the anti-interference function, and FIG. 15 a flow chart of an embodiment of the installation method.

5. DETAILED DESCRIPTION

With respect to FIG. 1, the construction of the installation tool 1 for a wire thread insert is shown based on the exploded view. The installation tool 1 includes a drive unit 10. The drive unit 10 may be driven electrically or pneumatically. It furthermore may comprise a start switch 12 in order to switch on or switch off the drive unit 10. Accordingly, the mandrel body 20 starts to rotate or interrupts its rotation when the start switch 12 is actuated. The drive unit 10 furthermore may include a rotation direction change switch 14. When it may be actuated in combination with the start switch 12, the rotation direction of the drive unit 10 reverses.

The mandrel body 20 includes a thread section 22 facing away from the drive unit 10. The wire thread insert to be installed is rotated or screwed on or from it.

The mandrel body has an inner hollow space in which a slider 24 is arranged. The slider 24 can be axially displaced via the actuation of a torque clutch or torque arrangement 30, respectively, as described in more detail below.

An opening to the inner hollow space of the mandrel body 20 is provided at an installation end of the mandrel body 20 which faces away from the drive unit 10. Accordingly, an installation blade 28 or the slider 24 may grip from the inside of the mandrel body 20 to the outside at this location in a displaceable manner. The installation end furthermore may include an installation structure in order to hold a wire thread insert on the thread section 22 in a torque-proof manner. The installation structure for a wire thread insert with a tang that can be bent back is described in DE 10 2010 050 735 and is incorporated by reference. For a wire thread insert with a radially extending installation tang, the installation structure alternatively consists of a radially extending depression or groove. Furthermore, the installation blade 28 can be used as the installation structure, the blade engaging into a notch that is arranged at a radial inner side of the wire thread insert.

A depth stop 26 may be arranged on the thread section 22. When the thread section 22 with wire thread insert is screwed into a thread opening up to the depth stop 26, the depth stop 26 blocks a further screwing-in as well as a further rotation of the mandrel body 20 in the screw-in direction or installation direction $R_I$, respectively.

The clutch arrangement 30 is provided within a housing Gin which the mandrel body 20 is held in a rotatable manner. The clutch arrangement 30 establishes a releasable connection between the drive unit 10 and the mandrel body 20. This releasable connection transfers the rotation movement of the drive unit 10 onto the mandrel body 20 or interrupts the force flow between the drive unit 10 and the mandrel body 20.

The torque clutch 30 may include a clutch lower part 32 which is spring-pretensioned against a clutch upper part 34. The spring pretension is generated by a spring 36. A clutch surface 38, 40 may be provided at the clutch upper part 34 and clutch lower part 32 each. These clutch surfaces 38, 40 face each other and are pressed against each other via the spring 36 in a releasable manner. Depending on the design of the clutch surfaces 38, 40, a form-fit and a force-fit connection between the clutch upper part 34 and the clutch lower part 32 arises, which transfers the rotation of the drive unit 10 onto the mandrel body 20.

Each clutch surface 38, 40 may comprise at least one cam 39, 41, two each, which are limited by adjacent valleys. Based on this shape, the clutch surfaces 38, 40 may fittingly engage into each other. In this connection, each cam 39, 41 comprises a vertex over which two contra-directionally inclined ramps are connected with each other.

In the configuration of the installation tool 1, the clutch upper part 34 is connected with the drive unit 10 in a torque-proof manner. The clutch lower part 32 may be connected with the mandrel body 20 in a torque-proof manner. At the same time, the clutch lower part 32 is, however, deflectable against the force of the spring 36 in an axial direction, i.e. in the direction of the mandrel body 20.

During the installation of the wire thread insert in the thread bore, the mandrel body 20 rotates with the wire thread insert in accordance with the thread direction of the receiving thread of the thread bore. As soon as the depth stop 26 runs aground the component with the thread bore, the mandrel body 20 is blocked from a further rotation. The torque, which is transferred by the drive unit 10 onto the clutch upper part 34 compared with the blocked clutch lower part 32, now reaches a limit value so that the clutch upper part 34 is rotated relative with respect to the clutch lower part 32.

The limit torque may be firstly determined by the pretension of the spring 36 between the clutch upper part 34 and the clutch lower part 32. In this connection, it may for example also be preferred that the adjoining clutch surfaces 38, 40 are configured smooth. A friction connection between the two clutch surfaces 38, 40, which would be determined by the surface friction alone, then sets the limit torque. For this purpose, the clutch surfaces 38, 40 may be also profiled or roughened.

According to the above-described embodiment, the clutch surfaces 38, 40 include engaging cams and valleys as they can be seen in FIGS. 5, 6, 8. A cam is correspondingly formed by two ramps extending towards one vertex. Depending on the inclination angle of the ramps which extend towards the common vertex, the limit torque of the torque clutch 30 can be adjusted. The steeper the ramps raise towards the vertex, the higher the limit torque must be in order to actuate the torque clutch 30.

The clutch lower part 32 is provided with an axial hollow space. It serves for receiving and moving a pin-like slider linkage 42. The slider linkage 42 may serve for transferring a linear movement along the longitudinal axis of the installation tool 1. Here, the movement of a clutch piston 44 within the clutch upper part 34 is transferred via the slider 24 onto the installation blade 28 or directly onto the installation blade 28. The slider 24 and the slider linkage 42 may be connected with the mandrel body 20 and/or the clutch lower part 32 in a torque-proof manner. Thus, they cannot be rotated against each other.

According to the disclosure, it may be preferred that the clutch upper part 34 is provided at least over an axial partial section as a hollow-cylindrical sleeve. In the inner cylindrical free space of the clutch upper part 34, the clutch piston 44 is held in an axially displaceable manner. For that, the clutch piston 44 may comprise at least one roller pin 46 which protrudes radially to the outside. The roller pin 46 is firmly arranged in the clutch piston 44. Furthermore, the roller pin 46 may be received and guided in a link motion or link guide 48 of the clutch upper part 34.

If the clutch arrangement 30 is in an unreleased state, the clutch upper part 34 rotates together with the clutch piston 44 and the clutch lower part 32. The rotation of the clutch piston 44 is based on the rotational dragging of the roller pin 46 by the link guide 48. Due to the form-fit connection between the cams 39, 41 and the valleys of the clutch surfaces 38, 40, the torque-proof connection of the clutch piston 44 with the mandrel body 20 arises through the slider linkage 42.

As soon as the clutch arrangement 30 is actuated, the clutch upper part 34 rotates with respect to the clutch lower part 32 and the rotationally blocked mandrel body 20. The clutch piston 44 may be connected with the clutch lower part 32 and/or the mandrel body 20 in a torque-proof manner. Thereby, the roller pin 46 remains in its rotation angle position while the link guide 48 of the clutch upper part 34 continues to move. As the link guide 48 comprises an inclination, the link guide 48 may be helically shaped, the clutch piston 44 is displaced in an axial direction in case of a relative movement between the clutch piston 44 and the clutch upper part 34. The intensity and the direction of the axial displacement of the clutch piston 44 is determined by the inclination and the course of direction of the link guide 48.

With reference to FIG. 4, firstly, the screwing-in of the wire thread insert into the thread opening is schematically illustrated (S3), until the depth stop 26 comes to a blocking position on the component (not shown). For this purpose, the thread section 22 may comprise a right-handed thread so that the drive unit 10 operates in a right-rotating way for the installation (see arrows in FIG. 4). In case of a left-handed thread on the thread section 22, the movements that are necessary for the drive and the installation are correspondingly carried out in an opposite direction.

After the depth stop 26 blocking a further rotation of the mandrel body 20, the clutch upper part 34 continues to rotate with respect to the clutch lower part 32 (see FIG. 5). As the clutch piston 44 is connected with the clutch lower part 32 in a torque-proof manner, the link guide 48 rotates relative with respect to the roller pin 46 arranged therein (S4).

According to the embodiment shown in FIG. 5, the link guide 48 has an inclination into the installation direction $R_I$, similar to a left-handed thread. Thus, in case the link guide 48 is rotated to the right side around the clutch piston 44, the link guide 48 displaces the clutch piston 44 via the roller pin 46 into the installation direction $R_I$. The slider 24 is axially displaced with this axial movement in order to displace the installation blade 28 from the inside of the mandrel body 20 to the outside (S4). By that, the further installation of the wire thread insert with tangs that may be bent back is prepared, as is described in DE 10 2010 050 735. Generally, moving out of the installation blade 28 is realized due to the axial movement of the clutch piston 44 into the installation direction $R_I$. This movement may be also used for ejecting an installation tang of a wire thread insert from a radial groove at the installation end of the thread section 22.

Analogously, it may also be preferred to move back an already moved-out installation blade 28 or an installation slider into the mandrel body 20. For this purpose, in case of a right-rotating drive unit 10, the link guide 48 may have the course similar to a right-handed thread. In this case, the relative movement between the clutch lower part 32 and the clutch upper part 34 would cause an axial displacement of the clutch piston 44 contrary to the installation direction $R_I$.

In case of a left-rotating drive unit 10, the link guide 48 would correspondingly have to be inclined in a contrary direction, i.e. in case of an axial displacement into the installation direction $R_I$ similar to a right-handed thread and opposite to the installation direction $R_I$ similar to a left-handed thread.

The displacement into the installation direction $R_I$ is schematically also shown in FIG. 7. Here, it can be seen how the axial displacement of the clutch piston 44 is transferred to the slider 24 and the installation blade 28 via the slider linkage 42. FIG. 10 shows how a axial displacement contrary to the installation direction $R_I$ takes place. As the clutch piston 44, the slider linkage 42, the slider 24 and the installation blade 28 may be axially coupled, the axial displacement of the clutch piston 44 leads to the installation blade 28 being retracted into the mandrel body 20.

After displacing the installation blade 28, the rotation direction of the drive unit 10 may be reversed (S7). According to a further embodiment, this takes place by actuating or pressing the start switch 12 and the rotation direction change switch 14 at the same time. It may also be preferred that only one switch for this function be provided or that the rotation direction be changed automatically. According to a further embodiment, precisely no interlocking of the switch for the change of the rotation direction takes place when the rotation direction is changed. In this way, the handling and application of the installation tool is facilitated.

According to a further embodiment, the mandrel body 20 with moved-out installation blade 28 now rotates to the left after screwing-in the wire thread insert with tangs that can be bent back and a right-handed thread. As described in DE 10 2010 050 735 in connection with the installation method of the wire thread insert with tangs that can be bent back, which is incorporated herein by reference, the tang that can be bent back or with redressible tangs of the wire thread insert is bent back into the thread of the thread opening (S5).

After that, a compression of the tang follows (S6). During compression, the installation blade 28 pushes against the tang, thereby blocking a further rotation of the mandrel body 20. This rotation blockage leads to an actuation of the clutch arrangement 30, similar to a running aground of the depth stop 26 as described above. Accordingly, the course which is described with respect to FIG. 5 takes place in a contrary direction, as is illustrated in FIG. 9. In this connection, the maximum torque with which the tang is compressed is regulated via the limit torque of the clutch arrangement 30.

The rotation blockage of the mandrel body 20 also blocks the clutch lower part 32. Accordingly, the clutch upper part 34 continues to rotate relative with respect to the clutch lower part 32 and axially displaces the clutch piston 44 contrary to the installation direction $R_I$.

Due to the axial displacement contrary to the installation direction $R_I$, the installation blade 28 is released from the engagement or attachment at the wire thread insert (S6). Due to this, the rotation blockage of the mandrel body 20 is raised and the thread section 22 is rotated out from the installed wire thread insert (S9).

Before the axial displacement of the installation blade 28 takes place, the installation blade 28 attaches to the end to be compressed of the wire thread insert. This attachment may be supported by a friction connection between the installation blade 28 and the end of the wire thread insert, which might make releasing the installation blade 28 by the mentioned axial displacement more difficult. It may therefore be preferred that a counter-rotation contrary to the pressing rotational movement takes place before the above-mentioned axial displacement in order to release the connection between the installation blade 28 and the wire thread insert. This counter-rotation comprises a rotation angle smaller than 360°, may be smaller than 180° or even smaller than 90°. Due to this counter-rotation, the installation blade 28 is released from the friction connection with the end to be compressed of the wire thread insert. This counter-rotation may relieve the installation blade 28. Subsequently, the above-described axial displacement of the installation blade 28 may take place, with this movement not being interfered by friction losses.

In order to be able to start a new installation process, the rotation direction of the drive unit 10 is firstly switched in the thread direction of the thread section 22. By that, a new wire thread insert can be rotated or screwed on the thread section 22 (S1) and be installed subsequently.

During the installation of a wire thread insert, it can happen that the thread section 22 tilts within the thread opening of the component without installing the wire thread insert. Due to the tilting, the limit torque of the clutch arrangement 30 is exceeded and the clutch arrangement 30 actuates. Accordingly, the installation blade is now in a position in which it could interfere a removal out of the wire thread insert from the thread opening and/or the rotating off of the wire thread insert from the thread section 22.

It may therefore be preferred that firstly, the mandrel body 20 be blocked in its rotation with the help of an anti-disruption or anti-interference blockage 50. The anti-interference blockage 50 may be a pin which is pressed against a plane surface or into an impression or into a groove at the mandrel body 20. The friction connection between the anti-interference blockage 50 and the mandrel body 20 which arises as a result prevents a rotation of the mandrel body 20. In this connection, it may also be preferred that the clutch lower part 32 be blocked. In this way, the same function is achieved as is caused by the above-described pin 50.

Now, the rotation direction of the drive unit 10 may be changed by simultaneously actuating the start switch 12 and the rotation direction change switch 14 (S7). The drive unit 10 which is displaced into rotation by that leads to an exceeding of the limit torque, as the drive unit 10 tries to rotate the clutch upper part 34 against the retained clutch lower part 32. Accordingly, the clutch arrangement 30 actuates and axially moves the clutch piston 44 and thus the installation blade 28 back into the start position. Now, the thread section 22 with the wire thread insert may be removed from the thread opening. Subsequently, it may be preferred that the wire thread insert which is still present on the thread section 22 is again installed in the thread opening. Alternatively, it may also be preferred that the wire thread insert which is still present on the thread section 22, be removed and that a new wire thread insert be rotated on. After completing the rotating on, the wire thread insert which has been rotated on anew can be installed in the thread opening of the component.

The invention claimed is:

1. An installation tool for a wire thread insert comprising the following features:

a. a drive unit, in particular an electric or pneumatic drive unit, which provides a switchable rotation movement between a first and a second direction, b. a mandrel body with a drive section for rotating the mandrel body and with a thread section onto which the wire thread insert is rotatable on and from which the wire thread insert is rotatable off, c. an installation blade which is movably arranged in the mandrel body between an engagement position and a rest position in order to attach in a targeted manner at the wire thread insert and/or to release itself from an attachment or engagement at the wire thread insert, and d. a torque clutch consisting of a form-fit and force-fit interlocking clutch upper part and clutch lower part, of which the clutch upper part is fixedly connected with the drive unit and the clutch lower part is torque-proof connected with the mandrel body, in which e. the clutch lower part and the clutch upper part are arranged against each other in a spring pretensioned manner, wherein the spring pretension is generated by a spring, so that in case of a rotation blockage of the clutch lower part over the mandrel body, the clutch upper part is rotatable with respect to the clutch lower part, with the clutch lower part giving way in a springy manner due to the spring, and f. the clutch upper part comprises a link guide defining a curvilinear path in the clutch upper part with which a clutch piston is axially displaceable depending on a rotation direction of the clutch upper part, wherein the clutch piston is axially guided in the clutch upper part with an at least one-sided radially protruding pin which engages into the link guide and the clutch piston is connected with the clutch lower part and/or the mandrel body in a torque-proof manner, while with g. a decoupled relative rotation between the clutch upper part and the clutch lower part, caused by exceeding a limit torque between the clutch upper part and the clutch lower part, the curvilinear path causes a relative axial displacement between the clutch upper part and the clutch piston when the clutch upper part is rotated relative to the clutch piston as the clutch piston does not co-rotate with the clutch upper part, wherein the relative axial displacement is transferred to the installation blade so that a relative movement between the mandrel body and the installation blade is generated.

2. The installation tool according to claim 1, in which the axial displacement of the clutch piston is transferable to the installation blade via an actuator and/or in which the axial displacement takes place depending on the rotation direction of the clutch upper part compared with the clutch lower part in the direction of the mandrel body or in the direction of the drive unit.

3. The installation tool according to claim 1, in which the clutch upper part and the clutch lower part each comprises in an axial orientation opposite to each other, a circumferential sequence of at least two contra-directional ramps being adjacent with respect to a common vertex, with the ramps defining an engagement contour between the clutch upper part and the clutch lower part.

4. The installation tool according to claim 3 in which an inclination angle of the ramps in combination with a spring pretension generated by a spring between the clutch upper part and the clutch lower part determines a limit torque, at which a relative rotation between the clutch upper part and the clutch lower part is generable.

5. The installation tool according to claim 1 which comprises an anti-disruption blockage with which a rotation movement of the mandrel body is blockable in a targeted manner so that in combination with a rotation direction reversion of the drive unit, the installation tool is displaceable into an initial state.

6. The installation tool according to claim 1 wherein the pin is a roller pin.

7. A torque clutch for a tool which comprises the following features:

a clutch upper part and clutch lower part engaging into each other in a form-fit and force-fit manner, of which the clutch upper part or the clutch lower part is connectable with a drive unit in a torque-proof manner and the other clutch part is connectable with an output unit in a torque-proof manner, wherein the clutch lower part and the clutch upper part are spring-pretensioned against each other, wherein the spring-pretension is generated by a spring, so that in case of a rotation blockage of the clutch lower part, the clutch upper part is rotatable with respect to the clutch lower part and the clutch part that is coupled to the drive unit comprises a link guide defining a curvilinear path in the clutch part that is coupled to the drive unit with which a clutch piston as an axial actuator is axially displaceable depending on a rotation direction of the clutch part that is coupled to the drive unit relative to the actuator, wherein the clutch piston is axially guided in the clutch part that is coupled to the drive unit with an at least one-sided radially protruding pin which engages into the link guide and the clutch piston is connected with the other clutch part in a torque-proof manner, while with a decoupled relative rotation between the clutch upper part and the clutch lower part, actuated by exceeding a limit torque between the clutch upper part and the clutch lower part, the curvilinear path causes a relative axial displacement between the clutch part that is coupled to the drive unit and the clutch piston when the clutch part that is coupled to the drive unit is rotated relative to the clutch piston as the clutch piston does not co-rotate with the clutch part that is coupled to the drive unit, wherein the relative axial displacement is transferrable to an axially movable actuation unit that is arranged within the output unit so that a linear relative movement is generated between the clutch part that is coupled to the drive unit and the axially movable actuation unit.

8. The torque clutch according to claim 7, in which the axial displacement of the clutch piston is transferrable via an actuator onto the actuation unit, and/or in which the axial displacement takes place depending on the rotation direction of the clutch upper part compared with the clutch lower part in the direction of the output unit or in the direction of the drive unit.

9. The torque clutch according to one claim 7, in which the clutch upper part and the clutch lower part each comprises in an axial orientation opposite to each other, a circumferential sequence of at least two contra-directional ramps being adjacent with respect to a common vertex, with the ramps defining an engagement contour between the clutch upper part and the clutch lower part.

10. The torque clutch according to claim 9, in which an inclination angle of the ramps in combination with a spring pretension generated by a spring between the clutch upper part and the clutch lower part determines a limit torque at which a relative rotation between the clutch upper part and the clutch lower part and a relative movement between an actuator and the clutch upper part or the clutch lower part is generable.

11. An installation method for a wire thread insert in a thread opening using an installation tool according to claim 1, comprising the following steps:

i) screwing or rotating the wire thread insert onto the mandrel body in a first rotation direction of the mandrel body, ii) placing the mandrel body with the wire thread insert in position at the thread opening and screwing the wire thread insert into the thread opening with the help of the mandrel body by rotating the mandrel body in the first rotation direction until a stop blocks a further axial screwing in of the mandrel body, iii) actuating the torque clutch by blocking the mandrel body so that the installation blade is displaced into an attachment position/operation position or is displaced from the operation position into a rest position, and iv) rotating the mandrel body in a second rotation direction until the wire thread insert in the thread opening is screwed or rotated off from the mandrel body.

12. The installation method according to claim 11, with the further step:

bending back an installation tang of the wire thread insert into a thread of the thread opening by means of the installation blade which is displaced into an engagement position, during rotation in the second rotation direction.

13. The installation method according to claim 12, with the further step:

compressing the installation tang after bending back and switching the torque clutch when reaching the limit torque in combination with a displacing of the installation blade from an attachment position at the wire thread insert into a rest position.

14. The installation method according to claim 11, with the further steps:

manual or automatic switching between the first and the second rotation direction and/or blocking a rotation of the mandrel body with an anti-disruption blockage and changing the rotation direction of the mandrel body, which causes an actuating of the torque clutch and a moving of the installation blade into an initial position.

* * * * *